US012479639B2

(12) United States Patent
Rittri

(10) Patent No.: US 12,479,639 B2
(45) Date of Patent: Nov. 25, 2025

(54) CONTAINER

(71) Applicant: Bluewater Innovations AB, Stockholm (SE)

(72) Inventor: Bengt Rittri, Stockholm (SE)

(73) Assignee: Bluewater Innovations AB, Stockholm (SE)

( * ) Notice: Subject to any disclaimer, the term of this patent is extended or adjusted under 35 U.S.C. 154(b) by 0 days.

(21) Appl. No.: 18/563,112

(22) PCT Filed: May 23, 2022

(86) PCT No.: PCT/EP2022/063893

§ 371 (c)(1),
(2) Date: Nov. 21, 2023

(87) PCT Pub. No.: WO2022/248403

PCT Pub. Date: Dec. 1, 2022

(65) Prior Publication Data

US 2024/0262590 A1 Aug. 8, 2024

(30) Foreign Application Priority Data

May 27, 2021 (SE) ..... 2150670-4
May 27, 2021 (SE) ..... 2150673-8

(51) Int. Cl.
*B65D 65/46* (2006.01)
*B65D 1/06* (2006.01)
(Continued)

(52) U.S. Cl.
CPC ..... *B65D 65/466* (2013.01); *B65D 1/06* (2013.01); *B65D 3/06* (2013.01); *B65D 3/16* (2013.01);
(Continued)

(58) Field of Classification Search
CPC ... B65D 1/06; B65D 3/06; B65D 3/12; B65D 3/16; B65D 13/04; B65D 65/466;
(Continued)

(56) References Cited

U.S. PATENT DOCUMENTS 1,225,610 A * 5/1917 Garner ..... B67C 11/02 141/331
1,432,718 A * 10/1922 Moore ..... B65D 3/06 206/520
(Continued)

FOREIGN PATENT DOCUMENTS

CN 101500898 A 8/2009
CN 104129574 A 11/2014
(Continued)

OTHER PUBLICATIONS

International Search Report received in International Application No. PCT/EP2022/063893, dated Sep. 23, 2022, in 11 pages.
(Continued)

*Primary Examiner* — Joshua G Kotis
(74) *Attorney, Agent, or Firm* — Knobbe, Martens, Olson & Bear, LLP

(57) ABSTRACT

There is disclosed a container configured to hold a substance and extending along an axis A. The container comprises a container body configured to hold the substance. The container body comprises a top part. Further, the container body comprises a closure section arranged in an opposite end of the container body compared to the top part. The closure section comprises a first circular cross-section with a first radius in a plane transverse to the axis A. The closure section further comprises a second circular cross-section with a second radius in a plane transverse to the axis A, the second radius is larger than the first radius. The closure segment further comprises an annular wall extending from the second circular cross-section to the first circular cross-section such
(Continued)

that the annular wall is formed with an angle alpha in relation to the axis A. The closure section is arranged so that the first circular cross-section is facing the top part. The container body further comprises a container wall extending from the closure section to the top part. The beverage container further comprises a sealing structure. The sealing structure comprises a circular bottom plate configured to seal the container body, and a sealing wall extending around the circular bottom plate. The sealing wall is tilted with the angle alpha in relation to the axis A. The sealing wall is configured to engage the annular wall, and the sealing structure is configured to be pressed into the closure section to seal the beverage container. Further, a method for filling such a container is provided.

12 Claims, 8 Drawing Sheets

(51) Int. Cl.

| | |
|---|---|
| ***B65D 3/06*** | (2006.01) |
| ***B65D 3/16*** | (2006.01) |
| ***B65D 21/02*** | (2006.01) |
| ***B65D 21/04*** | (2006.01) |
| ***B65D 41/04*** | (2006.01) |
| ***B65D 51/20*** | (2006.01) |
| ***B65D 65/42*** | (2006.01) |
| ***D21H 11/14*** | (2006.01) |
| ***D21H 21/16*** | (2006.01) |
| ***D21H 21/18*** | (2006.01) |
| ***D21H 27/10*** | (2006.01) |

(52) U.S. Cl.
CPC ..... *B65D 21/023* (2013.01); *B65D 21/04* (2013.01); *B65D 51/20* (2013.01); *B65D 65/42* (2013.01); *D21H 11/14* (2013.01); *D21H 21/16* (2013.01); *D21H 21/18* (2013.01); *D21H 27/10* (2013.01); *B65D 41/04* (2013.01); *B65D 2565/382* (2013.01)

(58) Field of Classification Search
CPC ..... B65D 21/023; B65D 21/0231; B65D 21/0233; B65D 21/04; B65D 51/20; B31B 2110/10
See application file for complete search history.

(56) References Cited

U.S. PATENT DOCUMENTS

| | | | | | |
|---|---|---|---|---|---|
| 1,776,458 | A | * | 9/1930 | Tsuchiya | B65D 3/02 229/5.5 |
| 1,858,864 | A | * | 5/1932 | Podel | B65D 41/16 215/352 |
| 1,862,835 | A | * | 6/1932 | Tsuchiya | B65D 3/12 493/109 |
| 2,125,417 | A | * | 8/1938 | Baker | B65D 43/022 229/5.5 |
| 2,134,427 | A | * | 10/1938 | Biderman | B65D 3/22 229/162.5 |
| 3,722,784 | A | | 3/1973 | Harper | |
| 4,261,502 | A | * | 4/1981 | Ohmori | B29C 66/81427 229/404 |
| 4,595,434 | A | * | 6/1986 | Eckstein | B65D 51/223 156/69 |
| 4,750,642 | A | * | 6/1988 | Eckstein | B29C 66/53461 222/541.2 |
| 5,209,795 | A | * | 5/1993 | DeRosa | B29C 66/112 53/329.3 |
| 5,230,429 | A | * | 7/1993 | Etheredge, III | B65D 51/002 206/459.1 |
| 5,820,016 | A | | 10/1998 | Stropkay | |
| 5,829,611 | A | * | 11/1998 | Beck | B65D 55/024 215/256 |
| 5,988,460 | A | * | 11/1999 | Brecheisen | B29C 49/04 222/572 |
| 5,996,859 | A | * | 12/1999 | Beck | B65D 47/0809 215/237 |
| 10,894,642 | B2 | * | 1/2021 | Cerveny | B65D 47/0804 |
| 2007/0284332 | A1 | | 12/2007 | Gowans et al. | |
| 2010/0084362 | A1 | | 4/2010 | Letchinger et al. | |
| 2010/0089776 | A1 | | 4/2010 | Anthony et al. | |
| 2010/0242249 | A1 | * | 9/2010 | Vroon | B29C 66/21 29/426.2 |
| 2010/0288723 | A1 | | 11/2010 | Meyer | |
| 2018/0009589 | A1 | * | 1/2018 | Ho | B65D 53/02 |
| 2020/0256016 | A1 | * | 8/2020 | Chung | D21H 21/16 |
| 2020/0407100 | A1 | * | 12/2020 | Hsu | B65D 3/22 |
| 2021/0047086 | A1 | * | 2/2021 | Prusko | B65D 47/0823 |
| 2022/0234781 | A1 | * | 7/2022 | Suvarna | B65D 15/08 |
| 2022/0402666 | A1 | * | 12/2022 | Koenigseder | B65D 47/0804 |
| 2023/0020804 | A1 | * | 1/2023 | Kawasaki | B65D 75/08 |
| 2024/0217692 | A1 | | 7/2024 | Rittri | |
| 2025/0000288 | A1 | | 1/2025 | Rittri | |

FOREIGN PATENT DOCUMENTS

| | | | | |
|---|---|---|---|---|
| CN | 211869935 | U | | 11/2020 |
| DE | 29906115 | U1 | | 8/1999 |
| DE | 20200901196 | U1 | | 6/2010 |
| FR | 428966 | A | | 9/1911 |
| GB | 1263107 | A | | 2/1972 |
| GB | 1353360 | A | | 5/1974 |
| JP | 2001171640 | A | * | 6/2001 |
| WO | WO 03/099548 | A1 | | 12/2003 |
| WO | WO 2010/045080 | A1 | | 4/2010 |
| WO | WO 2020/016409 | A1 | | 1/2020 |

OTHER PUBLICATIONS

Swedish Office Action received in Swedish Application No. 2150673-8, dated Dec. 23, 2021, in 6 pages.
Swedish Office Action received in Swedish Application No. 2150670-4, dated Dec. 23, 2021, in 6 pages.
International Search Report issued in International Application No. PCT/EP2022/062835 mailed Sep. 12, 2022, in 11 pages.
International Search Report and Written Opinion received in International Application No. PCT/SE2022/051087, dated Dec. 19, 2022, in 13 pages.

* cited by examiner

CONTAINER

TECHNICAL FIELD

The present disclosure relates generally to the technical field of containers and, more particularly, to stackable containers and, even more particularly to stackable containers made from paper materials.

BACKGROUND

Bottles and containers are today used all over the world and come in many different sizes, shapes, and materials. Some of the standard containers are today made from plastics or out of thin paper materials. Here follows a few examples and a few setbacks out of the many found in prior art.

Plastic materials are convenient to use to make containers. However, plastics are a generally not biodegradable or compostable and micro plastics and plastic waste are a big polluter ending up in nature and the oceans.

Beverage containers made of paper materials are usually closed using a plastic lid. For example, both take-away coffee mugs and resealable paper container, such as some Tetra Pak containers, often have lids made of plastics that are pressed or screwed on the container to close it. Which may also be problematic due to plastic pollution.

Many prior art containers are hard to stack and pack efficiently, both when filled and unfilled. This increases the environmental footprint of the products. Some prior art containers also require certain equipment for filling the container which makes it harder for new businesses to use the packaging containers for their product.

There is therefore a need in the field to provide new kinds of containers for at least partially removing some of the problems mentioned.

SUMMARY

The inventor has reached the insight that there is a need for a container which can be effectively sealed and suitable for holding a substance, such as a beverage, other types of foodstuff such as rice or salt, or granular products while being made of an at least partially biodegradable material. Further, the inventor has reached the insight that there is a need for a container with a shape that allows multiple containers to be packed compactly and efficiently both when filled and unfilled.

More and more sustainable solutions for reducing plastic pollution are becoming available to the market. Molding paper pulp, fiber-materials, is a standard way of making containers, trays, and other types of packaging. Generally, the steps are as follows: A mold is made to be a mirror image of the finished paper product; Holes are drilled through the mold and a screen attached to its surface; The mold is immersed into paper pulp; A vacuum is drawn through the holes when the mold is immersed in the paper pulp so that a layer of paper pulp sticks to the mold, the screen prevents pulp from clogging the holes.

The mold is removed, and the paper pulp stuck to the side of the mold is removed and dried, a paper product has been created. Depending on the type of paper product different techniques may be used for removing the product from the mold. In what is known as "wet" manufacturing a transfer mold mates with the fiber product and moves the formed "wet part" to a hot press which compresses and dries the fiber material to increase density and to provide a smooth external surface finish.

Other ways of molding paper pulp are available. For example, by pressing the material between a female and male mold water can be drained from the material and a paper product with a wanted shape may be created.

Paper materials, such as fiber-based products are recyclable, biodegradable, compostable and do not end up in the oceans in the same capacity as plastics. Therefore, they are preferable to be used as an alternative to many plastic products available today.

Paper materials are advantageous over plastic products in many aspects. However, beverage containers made from paper materials may need some sort of inner lining or coating depending on the beverage to be served and the time the beverage is to be kept inside the container. This may for example be some sort of coating along the inner surface of the container that is water impermeable. The coating may be made from many different materials such as cellulose-based materials or plastics.

Other factors that may increase the environmental footprint of a product is how well it can be stacked or packed to ensure that transport of a bulk of the product is as environmentally friendly as possible. Having a shape that allows for effective stacking is therefore important. Prior art containers are often non stackable and comprises shapes that is unsuitable for stacking the containers both when unfilled and filled.

The present disclosure seeks to provide at least some embodiments of a container which overcome at least some of the above-mentioned drawbacks. More specifically, the present disclosure aims at providing an at least partially biodegradable container which can be used for different beverages and foodstuff which is efficiently stacked both when filled and when empty. More specifically, the present disclosure aims at providing a stackable container shippable to companies/businesses in a stacked and unassembled manner which can easily be filled and sealed by the company wishing to sell their product. Further, the present disclosure aims at providing a container which is at least partially biodegradable, and which can be used for beverages or granular products, for example foodstuff products such as rice, salt, or beans.

In a first aspect of the present disclosure, there is provided a container configured to hold a substance and extending along an axis A. The container comprises a container body configured to hold the substance. The container body comprises a top part. Further, the container body comprises a closure section arranged in an opposite end of the container body compared to the top part. The closure section comprises a first circular cross-section with a first radius in a plane transverse to the axis A. The closure section further comprises a second circular cross-section with a second radius in a plane transverse to the axis A, the second radius is larger than the first radius. The closure segment further comprises an annular wall extending from the second circular cross-section to the first circular cross-section such that the annular wall is formed with an angle alpha in relation to the axis A. The closure section is arranged so that the first circular cross-section is facing the top part. The container body further comprises a container wall extending from the closure section to the top part. The container further comprises a sealing structure. The sealing structure comprises a circular bottom plate configured to seal the container body, and a sealing wall extending around the circular bottom plate. The sealing wall is tilted with the angle alpha in relation to the axis A. The sealing wall is configured to engage the annular wall, and the sealing structure is configured to be pressed into the closure section to seal the container.

In a second aspect of the present disclosure, there is provided a method for filling a container according to the first aspect. The method comprises arranging the container so that the closure section is arranged facing upwards. Then in a sequential step filling the container body via the closure section. Then in a sequential step closing the container body by pressing the sealing structure into the closure section and lastly arranging the container with the top part facing upwards.

Thus, there is provided a container and a method of filling a container with a first function of providing an easily sealed container for any kind of substance. The tilted annular wall is advantageous in that it provides a novel and easy way of closing a container. One may simply fill the container from the closure section and then press the sealing structure into the closure section to achieve a tight seal. The container is further advantageous in that it is easily stacked, both when unfilled and filled. For example, the container may arrive to a customer or factory in separate stacks. One stack holding multiple container bodies arranged in each other and another stack holding multiple sealing structures. This is an efficient an easy way of supplying stackable containers to a user who wants to fill and sell multiple containers with a substance, such as for example a beverage or a foodstuff. Due to the stack-ability of the container it is highly efficient when delivering many to a customer.

The container may be configured to be a container for beverages and the substance may be a fluid or a beverage. It is understood that the substance may be any type of substance suitable for storing in a container according to the invention. For example, the substance may be any type of foodstuff or beverage consumable by a human being.

According to an embodiment, the angle alpha is between 2-8 degrees, and more preferable between 4-6 degrees. The present embodiment is advantageous in that if the angle alpha is too big, the sealing structure will easily fall out from the closure section. If the angle is between, 2-8 degrees the sealing structure can be pressed into the closure section and a tight seal will be achieved. More preferably, alpha is between 4-6 degrees which will help achieve an even tighter seal.

According to another embodiment, the top part comprises a spout connected to the container body and configured to deliver the substance to a user. The top part further comprises a lid element configured to seal the spout. The spout comprises an annular spout wall tilted an angle between 2-8 degrees in relation to the axis A, and the lid element comprises a lid indentation and is configured to be pressed down on the spout. The present embodiment is advantageous in that the sealing structure does not have to be removed to reach the substance, for example to drink in case the substance is a beverage. A user may remove a lid element which is pressed onto a spout placed on the top part. The spout and the lid element are closed in the same fashion as the closure section and the sealing structure, but instead it is the lid element which is pressed onto the spout achieving a seal. The present embodiment is suitable for reusable and refillable containers. A user may fill the bottle through the spout. A user may also fill the bottle through the bottom, the closure section, the first time and then sequentially through removing the lid element and filling through the spout.

According to another embodiment, the spout comprises a spout sealing rim extending around the annular spout wall. The lid element comprises a spout sealing recess extending around the lid indentation and configured to receive the spout sealing rim upon pressing the lid element onto the spout. The present embodiment is advantageous in that it creates an even tighter seal than without a spout sealing rim. A user may press the lid element onto the spout until the spout sealing rim is placed within the spout sealing recess. This construction will help in creating a strong seal which will prevent any spillage of the substance, for example a beverage.

According to another embodiment, the top part comprises a spout connected to the container body and configured to deliver the substance to a user. The spout comprises a set of spout threads extending around the spout. The top part further comprises a lid element configured to seal the spout and comprising a set of corresponding threads configured to receive the set of spout threads upon screwing the lid element onto the spout. The present embodiment is advantageous in that the sealing structure does not have to be removed to reach the substance, for example to drink. A user may remove a lid element which is screwed onto the spout using threads. The present embodiment is suitable for reusable and refillable containers. A user may fill the bottle through the spout. A user may also fill the bottle through the bottom, the closure section, the first time and then sequentially through removing the lid element and filling through the spout.

According to another embodiment, the container further comprises a sealing surface extending across the top part to ensure that the substance is kept inside the container body. The sealing surface comprises a piercing segment, and the piercing segment comprises a material pierceable by a drinking straw. The present embodiment is advantageous in that the sealing structure does not have to be removed to reach the substance, for example to drink. A user may simply pierce the piercing segment with a drinking straw to reach the substance, preferably a beverage in the present embodiment. The present embodiment is suitable for single use containers.

According to another embodiment, the sealing wall comprises a sealing rim extending around the sealing wall and protruding in a radial direction from the sealing wall and from the axis A. The closure section comprises a receiving recess extending around an inside of the closure section and configured to receive the sealing rim when the sealing structure is pressed into the closure section. The present embodiment is advantageous in that the seal achieved may be even tighter than the seal without the sealing rim and receiving recess. The sealing rim is pressed into the receiving recess and achieves a seal. Further, it is advantageous in that a user may know when the container is closed sufficiently by feeling when the sealing rim is received in the receiving recess. It is understood that there may be more than one sealing rim and more than one receiving recess.

According to another embodiment, the sealing structure comprises a contrasting color compared to the container body, and the sealing structure is configured to be fully enclosed by the closure section. The present embodiment is advantageous in that it may help a user understand when the container is sufficiently closed. If the sealing structure is not correctly placed it will stick out from the closure section, and due to the contrasting color be visible to the user. This is advantageous in that the user then may correct the mistake and close the container correctly.

According to another embodiment, the circular bottom plate is placed at a top end of the sealing wall so that the sealing structure comprises a hollow space facing away from the container body along the axis A. The present embodiment is advantageous in that the hollow space will be sufficiently large to accept the top of another container. This is advantageous when packing or stacking many of the containers and allows for a tight and compact packing. This may help in decrease the environmental footprint of the product and lower the cost of transport.

According to another embodiment, the container is made of a paper material. The present embodiment is advantageous in that the paper material is biodegradable and more environmentally friendly than plastic. It is further advantageous in that paper material can easily be made quite stiff or rigid which is preferable. With paper material it is meant any kind of paper material, cellulose-based material or fiber-based material that is recyclable and/or biodegradable. The paper material may be formed by different kinds of mixtures of fiber materials, recycled materials or other type of materials used in paper making.

According to another embodiment, the paper material is formed by fiber-based slurry comprising a fiber base comprising at least 50% by weight of old corrugated container (OCC), a moisture barrier, and an oil barrier. The moisture barrier and the oil barrier are in a range of about 1%-4% by weight respectively. The present embodiment is advantageous in that OCC is a recycled material which further decreases the environmental footprint of the product.

According to another embodiment, the paper material is formed by a fiber-based slurry comprising a fiber base comprising at least 10% softwood (SW), a moisture barrier, and an oil barrier. The moisture barrier and the oil barrier are in a range of about 1%-4% by weight respectively. The present embodiment is advantageous in that SW, for example bamboo or bagasse, is an environmentally preferable material to plastic. Further, a fiber-based slurry with the mentioned components creates a good mixture for a beverage container or bottle. The present embodiment is further advantageous in that some SW-materials are the residues from other industries and is therefore material which does not drain the resources of the planet more than necessary but instead may help give the product a decreased environmental footprint.

According to another embodiment, the paper-material is formed by vacuum forming a fiber-based slurry. The present embodiment is advantageous in that it is a standard way of making paper products and the techniques are readily available. Other kinds of forming, such as pressing a fiber-based slurry or mixture in mold are also possible.

According to another embodiment, the fiber-based slurry further comprises a strength additive in a range of 1.5%-4% by weight. The present embodiment is advantageous in that adding a strength additive makes the product, the bottle, more rigid in that the dry strength is improved. Further, other advantageous such as increases drainage and retention are features of adding a strength additive.

According to another embodiment, at least an inside surface of the container body or a top side of the sealing structure comprises an impermeable coating layer. The present embodiment is advantageous in that different beverages affect paper materials differently. For some beverages a coating may be necessary to keep the integrity of the beverage container and keep it from affecting the flavor of the beverage. The coating may be made from many different materials such as cellulose-based materials or plastics.

According to another embodiment the lid element further comprises an annular shoulder element intended to engage an inside wall of the spout. The annular shoulder element may, when the lid element is pressed on to the beverage container and the spout, provide further sealing of the container. Further, having an annular shoulder element engaging an inside wall of the spout provides more structural integrity for the container which is advantageous.

It is noted that other embodiments using all possible combinations of features recited in the above described embodiments may be envisaged. Thus, the present disclosure also relates to all possible combinations of features mentioned herein. Any embodiment described herein may be combinable with other embodiments also described herein, and the present disclosure relates to all combinations of features.

BRIEF DESCRIPTION OF THE DRAWINGS

Exemplifying embodiments will now be described in more detail, with reference to the following appended drawings.

DETAILED DESCRIPTION

Figure 1:
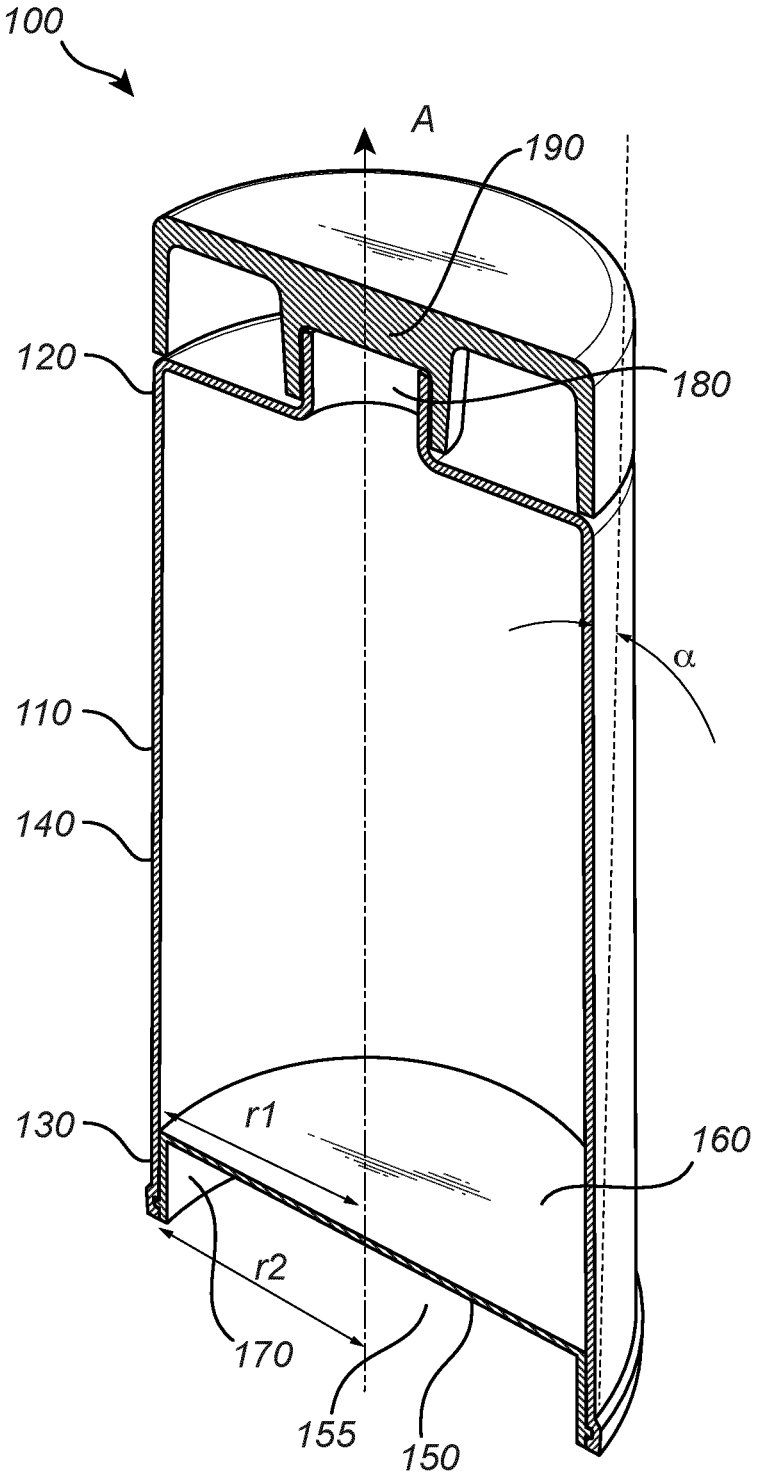
FIG. 1 schematically illustrates an exemplary container in accordance with an embodiment.

As illustrated in the figures, the sizes of the elements and regions may be exaggerated for illustrative purposes and, thus, are provided to illustrate the general structures of the embodiments. Like reference numerals refer to like elements throughout.

Exemplifying embodiments will now be described more fully hereinafter with reference to the accompanying drawings, in which currently preferred embodiments are shown. The invention may, however, be embodied in many different forms and should not be construed as limited to the embodiments set forth herein; rather, these embodiments are provided for thoroughness and completeness, and fully convey the scope of the invention to the skilled person.

It is understood that the shape of the embodiments shown in the figures may be altered depending on the usage for the container. Different shapes are convenient in different situations, and the container may for example resemble the standard take-away cups or plastic bottles available today or they may not. The drawings are not intended to narrow the scope of protection for the shape of the beverage container.

Throughout the detailed description, the container will be referred to as a beverage container and the substance it holds as a beverage. However, it is understood that other types of containers comprising the features of the beverage container discussed below are equally plausible. The substance may for example be rice, salt, coffee grounds, beans and other types of foodstuffs, such as granular foodstuffs, and the container may then be referred to as a foodstuff container. The description is not intended to narrow the scope of protection but merely provide one example for which a container according to the invention may be used.

With reference to FIG. 1 there is disclosed an illustration of a beverage container 100 according to an embodiment of the invention.

The beverage container 100 is configured to hold a beverage and is extending along an axis A. The beverage container 100 comprises a container body 110 which is configured to hold the beverage. The container body 110 comprises a top part 120 and a closure section 130 arranged in an opposite end of the container body compared to the top part. The closure section 130 comprises a first circular cross-section with a first radius r1 in a plane transverse to the axis A. The closure section further comprises a second circular cross-section with a second radius r2 in a plane transverse to the axis A. The second radius r2 is larger than the first radius r1. Further, the closure section comprises an annular wall extending from the second circular cross-section to the first circular cross-section such that the annular wall is formed with an angle alpha α in relation to the axis A. The closure section 130 is arranged so that the first circular cross-section is facing the top part 120. The beverage container 100 further comprises a container wall 140 extending from the closure section 130 to the top part 120.

The beverage container 100 further comprises a sealing structure 150. The sealing structure comprises a circular bottom plate 160 configured to seal the container body 110. The sealing structure 150 further comprises a sealing wall 170 extending around the circular bottom plate 160 and tilted with the angle α in relation to the axis A. The sealing wall 170 is configured to engage the annular wall. The sealing structure 150 is configured to be pressed into the closure section 130 to seal the beverage container 100.

The closure section 130 is arranged so that it has an at least partially conical shape and the sealing structure 150 is arranged so that it fits the shape of the closure section 130 so that when it is pressed into the closure section 130 it is stuck and creates a seal for the beverage container 100. This is achieved by choosing a suitable angle alpha α.

The angle alpha α may be between 2-8 degrees. It may also be between 4-6 degrees. The angle alpha α may be picked depending on the material of the beverage container 100 and depending on the friction that is created between the sealing wall 170 and the closure section 130. A too large angle alpha α is not preferable since the sealing structure 150 may fall out of the closure section 130. An angle alpha α around 6 degrees is preferable.

However, it may, as stated, be different angles for different embodiments and materials that are preferable.

The beverage container 100 disclosed in FIG. 1 has more features. The top part 120 comprises a spout 180 which is fluidly connected to the container body and is configured to deliver the beverage to a user. The beverage container 100 and top part 120 further comprises a lid element 190 configured to seal the spout 180. The spout comprises an annular spout wall tilted an angle between 2-8 degrees in relation to the axis A. The lid element 190 comprises a lid indentation 195 and is configured to be pressed down on the spout. The present embodiment is advantageous in that the sealing structure 130 does not have to be removed to drink. A user may remove a lid element 190 which is pressed onto a spout 180 placed on the top part. The spout 180 and the lid element 190 are closed in the same fashion as the closure section 130 and the sealing structure 150, but instead it is the lid element 190 which is pressed onto the spout 180 achieving a seal. The present embodiment is suitable for reusable and refillable beverage containers 100. A user may fill the bottle through the spout 180. A user may also fill the bottle through the bottom, the closure section 130, the first time and then sequentially through removing the lid element 190 and filling through the spout 180.

In the beverage container 100 of FIG. 1 the circular bottom plate 160 is placed at a top end of the sealing wall 170 so that the sealing structure 150 comprises a hollow space 155 facing away from the container body 110 along the axis A. The present embodiment is advantageous in that the hollow space 155 may be sufficiently large to enclose the top of another beverage container 100. This is advantageous when packing or stacking many of the beverage containers 100 and allows for a tight and compact packing. This may help in decreasing the environmental footprint of the product and the cost of transporting.

The sealing structure 150 may comprise a contrasting color compared to the container body 110, and the sealing structure 150 may be configured to be fully enclosed by the closure section 130. The present embodiment is advantageous in that it may help a user understand when the beverage container 100 is sufficiently closed. If the sealing structure 150 is not correctly placed it will stick out from the closure section 130, and due to the contrasting color be visible to the user. This is advantageous in that the user then may correct the mistake and close the beverage container 100 correctly.

Prior art beverage containers are often inversed compared to the beverage container 100 of FIG. 1, so that a larger circular cross-section of the cup is placed at the top of the container. However, this is ineffective when it comes to the packaging of many containers seeing that there is no way of stacking them easily. The present embodiment is advantageous in that it allows for a refillable paper material beverage container which is easily stacked in larger quantities.

The beverage container 100 is easily stacked both when filled and when unfilled. When the different parts of the beverage container 100 are delivered they may be stacked in a convenient way. For example, many container bodies 110 may be stacked inside one another and many sealing structures 150 may be stacked inside one another. This would allow a user filling many beverage containers 100 with a beverage (or with any other substance, such as rice or salt) may take a container body 110 from one stack. Then fill the container body 110 and take a sealing structure 150 from another stack and close the beverage container 100. The invention provides an easy and efficient way for customers to fill plenty of containers 100 without the need for special machines or equipment.

The beverage container 100 may be made of a paper material. In some embodiments only certain parts of the beverage container may be made of a paper material.

With paper material is meant any material that is made of fiber-based, cellulose-based materials or similar materials that are biodegradable and recyclable.

The parts of the beverage container 100 may for example be made of a fiber-based material. For example, a fiber-based slurry can be pressed or shaped to form some sort of paper material, cardboard material, or other biodegradable material.

The paper material may be formed by a fiber-based slurry. Fiber-based products are biodegradable, compostable and do not end up in the oceans in the same capacity as plastics. Therefore, they are preferable to be used as an alternative to many plastic products available today.

In different embodiment the parts of the beverage container 100 may be formed by different types of fiber-based slurries. Here follow a few examples, however they are not seen as limiting and other materials and mixtures and proportions are also considered.

The paper material may be formed by a fiber-based slurry that may comprise at least 50% by weight of old corrugated container (OCC). Further, it may comprise a moisture barrier, and an oil barrier. The moisture barrier and the oil barrier may be in a range of about 1%-4% of weight respectively.

The paper material may be formed by a fiber-based slurry that may, in another embodiment, comprise at least 10% softwood (SW). Further, it may comprise a moisture barrier, and an oil barrier. The moisture barrier and the oil barrier may be in a range of about 1%-4% of weight respectively.

The fiber-base slurry may also have a base fiber from any of the following groups: bagasse, bamboo, newsprint (NP). Other types of fiber materials are also available for forming the paper material.

The fiber-based slurry may also comprise a strength additive in a range of 1.5%-4% by weight. This may be added to enhance structural rigidity.

Molding paper pulp, fiber-materials, is a standard way of making containers, trays, and other types of packaging. Generally, the steps are as follows: A mold is made to be a mirror image of the finished paper product; Holes are drilled through the mold and a screen attached to its surface; The mold is immersed into paper pulp; A vacuum is drawn through the holes when the mold is immersed in the paper pulp so that a layer of paper pulp sticks to the mold, the screen prevents pulp from clogging the holes.

The mold is removed, and the paper pulp stuck to the side of the mold is removed and dried, a paper product has been created. Depending on the type of paper product different techniques may be used for removing the product from the mold. In what is known as "wet" manufacturing a transfer mold mates with the fiber product and moves the formed "wet part" to a hot press which compresses and dries the fiber material to increase density and to provide a smooth external surface finish.

The parts of the beverage container 100 may be formed according to the above stated procedure by the fiber-based slurry and a vacuum former. It may be formed for example by a method containing the steps of providing a fiber-based slurry mixture. Immersing a mold including a wire mesh comprising a mirror image of parts of the beverage container to be formed. Then drawing a vacuum across the wire mesh to cause the fiber-based slurry to accumulate at a surface of the wire mesh. Then removing the mold from the fiber-base slurry mixture, removing molded parts from the surface of the wire mesh. Lastly pressing the molded parts in a hot press. However, other steps of standard vacuum forming may be incorporated into the method for achieving a functional beverage container 100 and corresponding container parts.

The different parts of the beverage container may be formed in other ways as well. For example, a female and male mold of the container body 110 may be constructed. A fiber-based slurry, or other suitable material, may be poured into the female mold. The male mold may then be used to press the material to the sides of the female mold creating the correct shape. The molds may be constructed so that the water within the material is drained away through a mesh in the female and male mold while pressing.

Other ways of forming the beverage container and the different parts of the beverage container are also possible and the skilled man understands that different options are available. Depending on the part and depending on different features of the embodiments different ways of forming the paper material may be preferable.

It may further be advantageous for the beverage container to comprise a water impermeable coating. The coating may be made of a plastic material and may be a thin sheet covering an inside of the beverage container. For example, an inner side of the wall 140 and a top side of the circular bottom plate 160. The coating may be impermeable and allow for the beverage to be stored without penetrating the coating and reaching the walls of the beverage container. The coating may be made from a plastic material or any other suitable material which is water impermeable, for example some cellulose-based materials.

Depending on the beverage stored within the beverage container 100 and the time the beverage is stored the beverage container 100 may comprise such a coating. Some beverages affect or damage paper-materials more than others, and therefore a coating may be needed for certain beverages. Further, depending on the storage time of the beverage within the beverage container 100 a coating may be preferable. The longer a beverage is kept within the beverage container 100 the higher the risk that the beverage container 100 is affected be the beverage. Therefore, a coating may be preferable for beverages containers 100 configured to store a beverage a longer period.

The coating may have different thicknesses depending on the material it is made from and depending on the beverage to be stored.

Further, it is also possible that parts of the beverage container are made of other materials. For example, the lid element 190 may be made of plastic, silicon, or a metal. The lid element 190 may then be used multiple times and on different beverage container 100 in case of the original beverage container 100 being damaged. It may be advantageous in making some parts of the beverage container 100 from material that is more durable and suitable for long time use and some parts of the beverage container 100 of more environmentally friendly material such as fiber-based materials. For example, a silicon or metal lid element 190 may be customizable and fit all beverage containers 100. A user may then have a lid element 190 with a certain color so that a user knows it is their beverage container 100.

It is further envisioned that the lid element 190 may comprise an annular shoulder element intended to engage an inside wall of the spout 180. The annular shoulder element may provide further sealing of the beverage container 100. Further, having an annular shoulder element engaging an inside wall of the spout 180 provides more structural integrity for the beverage container which is advantageous. When closing the beverage container 100 by pressing the lid element 190 onto the spout 180 the lid element will then provide a tight seal on both the outside and the inside of the spout 180.

There is also provided a method for filling a beverage container 100 as disclosed within the application. The method comprises the steps of arranging the beverage container 100 so that the closure section 130 is arranged facing upwards. Then in a sequential step filling the container body 110 via the closure section 130. Then in a sequential step closing the container body 110 by pressing the sealing structure 150 into the closure section 130 and lastly arranging the beverage container 100 with the top part 120 facing upwards.

Filling the beverage container 100 from the closure section 130 may be advantageous to do when filling the beverage container 100 the first time. Sequential times, if the beverage container 100 is used as a refillable container, a user may fill the beverage container 100 through the spout 180 by removing the lid element 190.

Figure 2A:
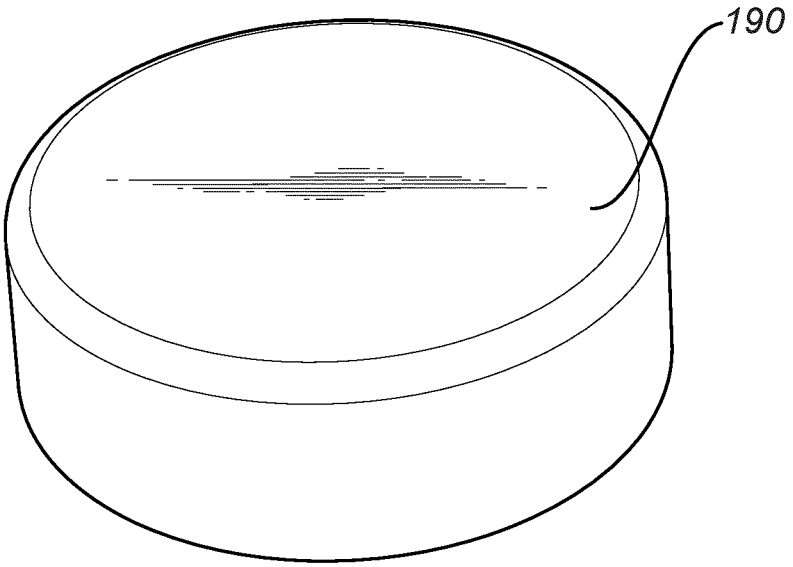
FIGS. 2*a* and 2*b* schematically illustrates a lid element of an exemplary container in accordance with an embodiment.
Figure 2B:
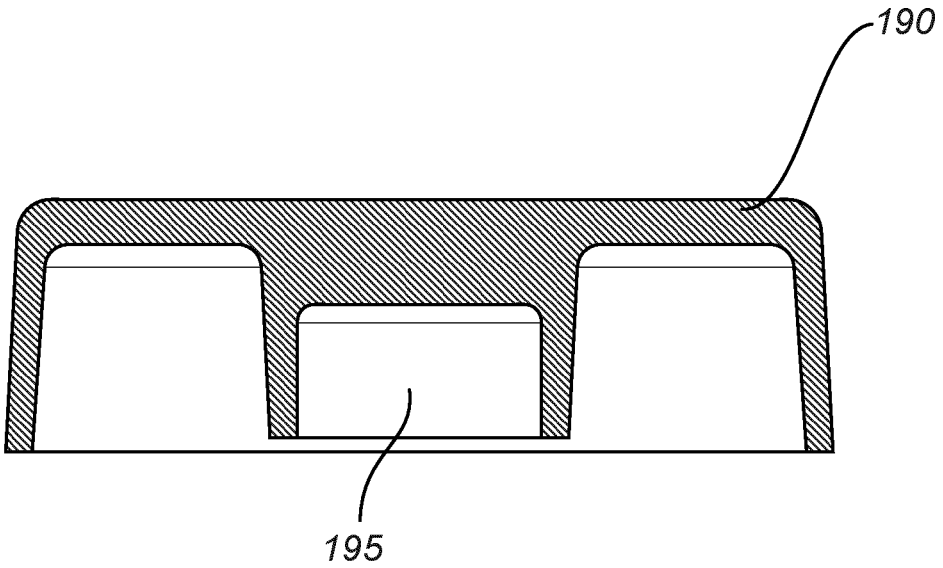

With reference to FIGS. 2*a* and 2*b* there is disclosed illustrations of a lid element 190 of an exemplary beverage container 100 according to an embodiment of the invention.

The lid element 190 disclosed in FIGS. 2*a* and 2*b* is configured to be placed onto a beverage container 100 as disclosed in relation to FIG. 1.

The lid element 190 comprises a lid indentation 195 which is configured to be fitted onto a spout of a beverage container. The lid indentation comprises an inner wall which is tilted an angled between 2-8 degrees so that it has the same tilt as the corresponding spout of the beverage container.

In other embodiments the lid element 190 may comprise a spout sealing recess extending around the lid indentation 195. The spout sealing recess would be configured to receive a spout sealing rim extending around an outer wall of a spout so that the seal is achieved when pressing the lid element 190 onto the spout is tighter.

It is further envisioned that the lid element 190 may comprise an annular shoulder element intended to engage an inside wall of the spout. The annular shoulder element may provide further sealing of the beverage container. Further, having an annular shoulder element engaging an inside wall of the spout provides more structural integrity for the beverage container which is advantageous. When closing the beverage container by pressing the lid element 190 onto the spout the lid element will then provide a tight seal on both the outside and the inside of the spout.

Figure 3:
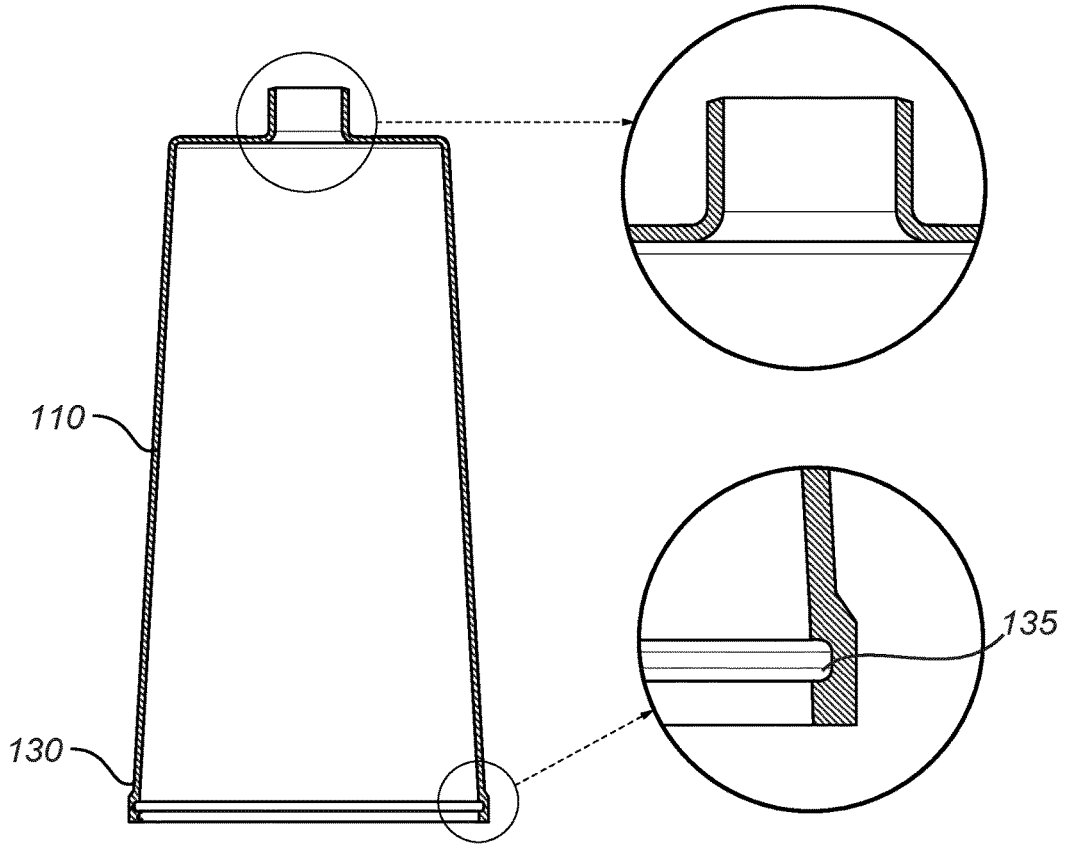
FIG. 3 schematically illustrates an exemplary container in accordance with an embodiment.

With reference to FIG. 3 there is disclosed an illustration of a container body 110 of a beverage container 100 according to an embodiment of the invention.

The closure section 130 of the beverage container 100 in FIG. 3 further comprises a receiving recess 135 extending around an inside of the closure sections 130 annular wall. The receiving recess 135 is configured to receive a sealing rim that the sealing wall of a sealing structure comprises, more detail regarding such a sealing rim is found in FIG. 4. It is understood that the closure section 130 may comprise more than one receiving recess 135 wherein each of the receiving recesses 135 would be configured to receive a corresponding sealing rim.

The present embodiment is advantageous in that the seal achieved may be even tighter than the seal without the sealing rim and receiving recess 135. The sealing rim is pressed into the receiving recess 135 and achieves a seal. Further, it is advantageous in that a user may know when the beverage container is closed sufficiently by feeling when the sealing rim is received in the receiving recess 135.

Figure 4A:
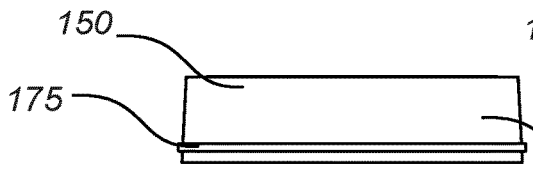
FIGS. 4*a* and 4*b* schematically illustrates a sealing structure of an exemplary container in accordance with an embodiment.
Figure 4B:
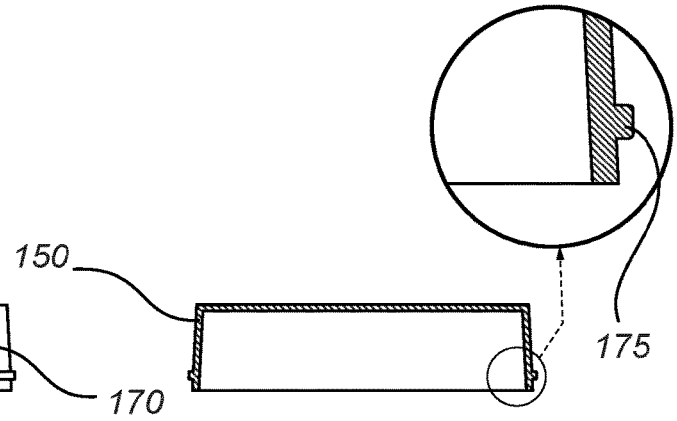

With reference to FIGS. 4*a* and 4*b* there is disclosed illustrations of a sealing structure 150 of a beverage container 100 according to an embodiment of the invention.

The sealing structure 150 of FIGS. 4*a* and 4*b* comprises a sealing rim 175 extending around the sealing wall 170 and protruding in a radial direction from the sealing wall 170 and from the axis A. The sealing rim 175 is configured to be received by a receiving recess as disclosed in relation to FIG. 3. It is understood that there may be more than one sealing rim 175.

Figure 5A:
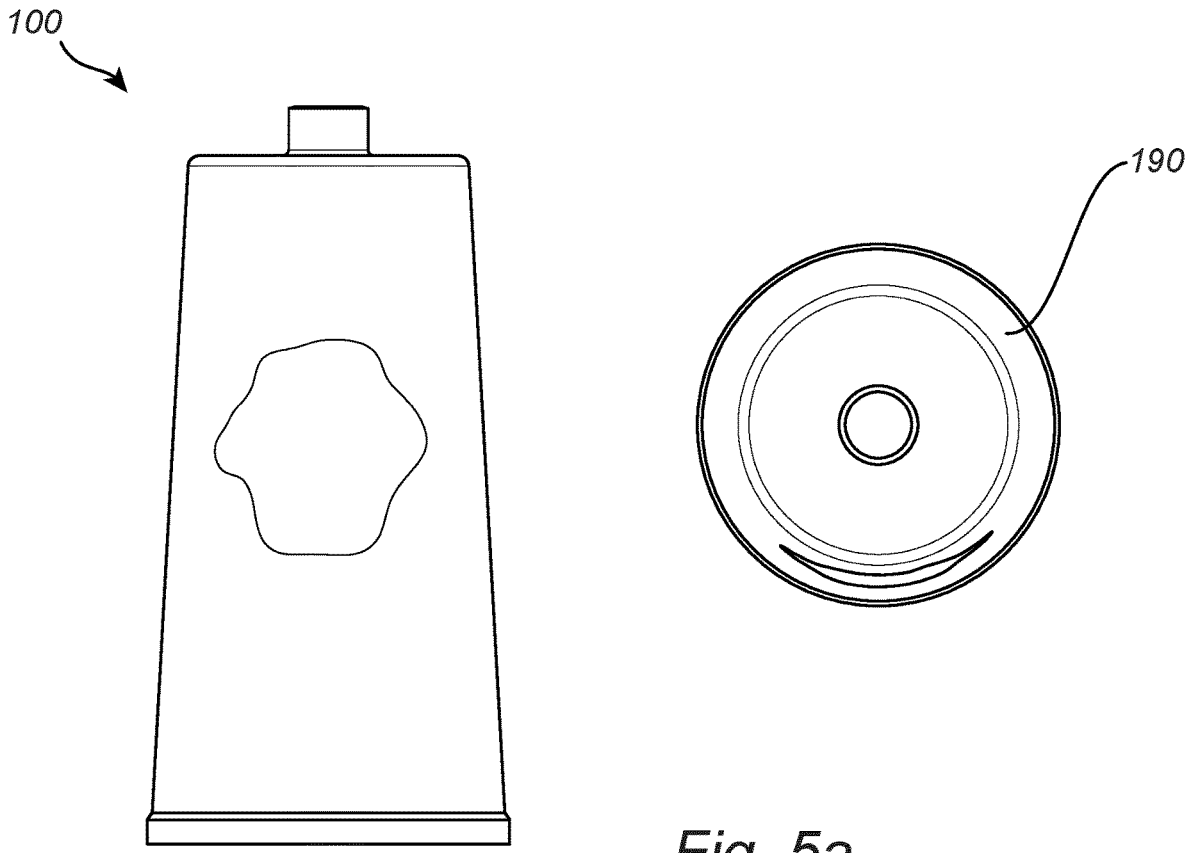
FIGS. 5*a* and 5*b* schematically illustrates an exemplary container in accordance with an embodiment.
Figure 5B:
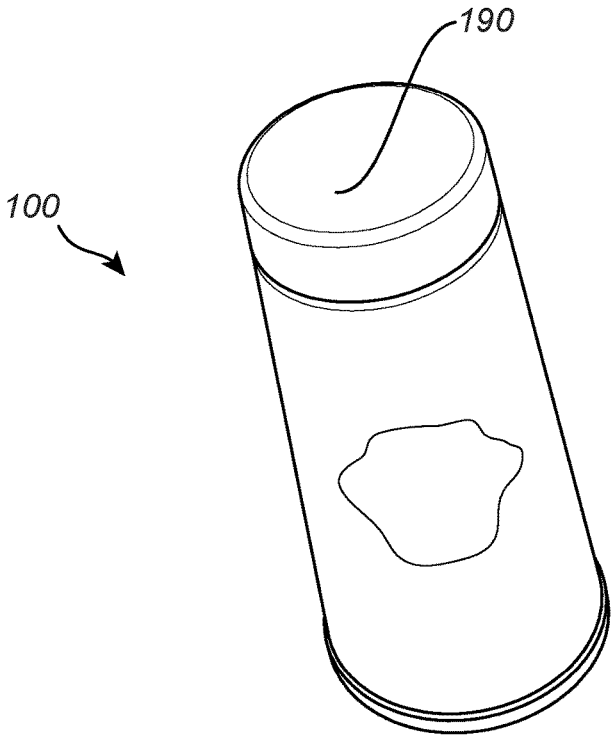

With reference to FIGS. 5*a* and 5*b* there is disclosed illustrations of a beverage container 100 according to an embodiment of the invention.

The beverage container 100 in FIG. 5*a* shows the beverage container with the lid element 190 removed from the spout 180 and top part 120. The beverage container 100 may now be suitable to be filled or refilled or used to drink from.

The beverage container 100 in FIG. 5*b* shows the beverage container with the lid element 190 placed on the spout 180 and the top part 120. The beverage container 100 is closed and prepared for packing or storing.

Figures 6A, 6B:
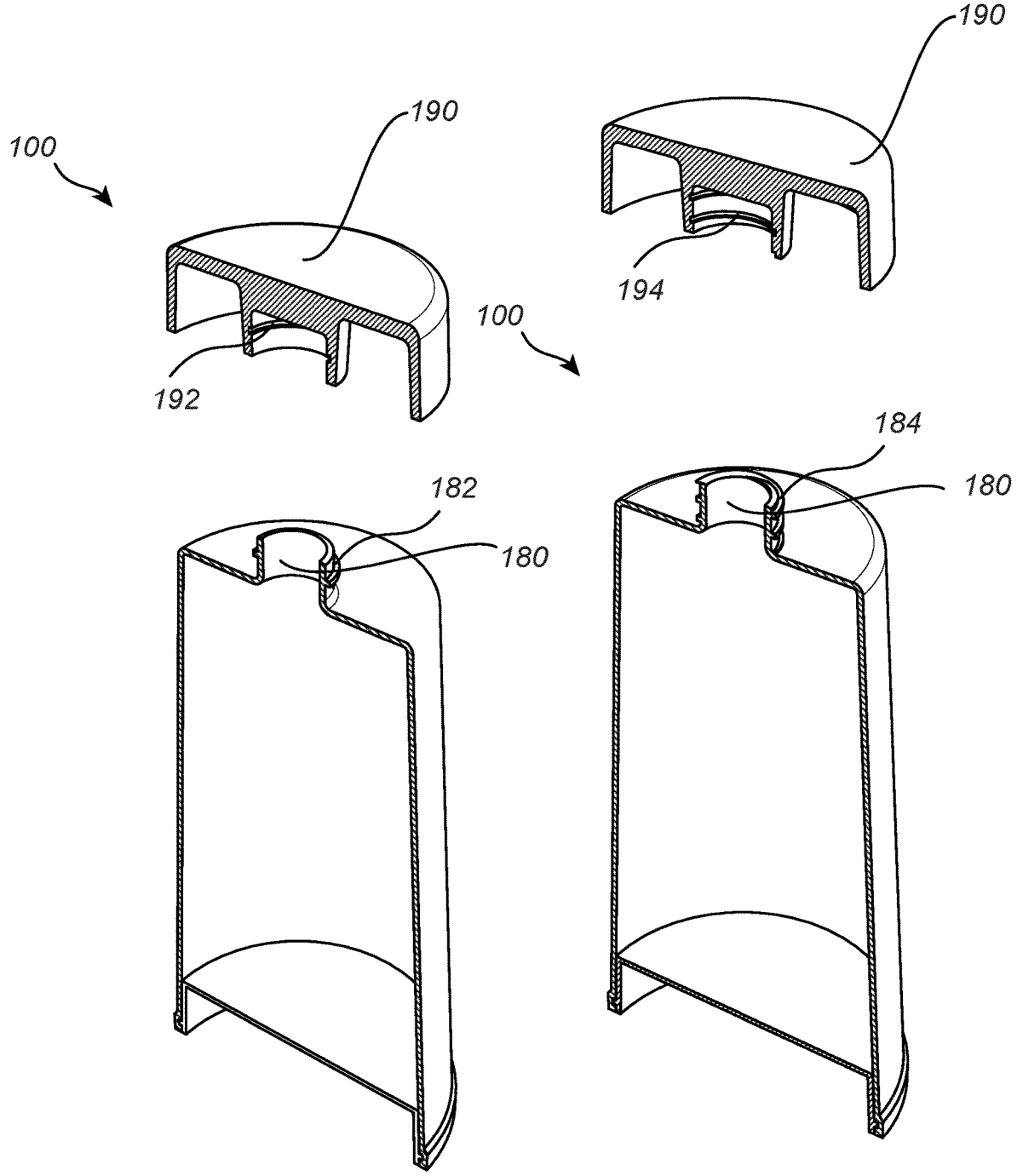
FIGS. 6*a*, 6*b* and 6*c* all schematically illustrates an exemplary container in accordance with an embodiment.

With reference to FIG. 6*a* there is disclosed an illustration of a beverage container 100 according to an embodiment of the invention.

Further details regarding the spout 180 and lid element 190 can be found in relation to the previous Figures. However, in the embodiment of the beverage container 100 in FIG. 6 the spout 180 comprises a spout sealing rim 182 extending around the annular spout wall. The lid element 190 comprises a spout sealing recess 192 extending around the lid indentation and configured to receive the spout sealing rim 182 upon pressing the lid element 190 onto the spout 180.

The present embodiment is advantageous in that it creates an even tighter seal than without a spout sealing rim 182. A user may press the lid element 190 onto the spout 180 until the spout sealing rim 182 is placed within the spout sealing recess 192. This construction will help in creating a strong seal which will prevent any spillage of the beverage.

With reference to FIG. 6*b* there is disclosed an illustration of a beverage container 100 according to an embodiment of the invention.

In the embodiment of the beverage container 100 in FIG. 6*b* the top part 120 comprises a spout 180 fluidly connected to the container body 110 and configured to deliver the beverage to a user. The spout 180 comprises a set of spout threads 184 extending around the spout 180. The top part 120 further comprises a lid element 190 configured to seal the spout 180 and comprising a set of corresponding threads 194 configured to receive the set of spout threads 184 upon screwing the lid element 190 onto the spout 180.

The present embodiment is advantageous in that the sealing structure 150 does not have to be removed to drink. A user may remove the lid element 190 which is screwed onto the spout 180 using threads. The present embodiment is suitable for reusable and refillable beverage containers 100. A user may fill the bottle through the spout 180. A user may also fill the bottle through the bottom, the closure section 130, the first time and then sequentially through removing the lid element 190 and filling through the spout 180.

The lid element 190 of FIG. 6*b* may be difficult to construct from a paper material. Other materials may be advantageous to construct the threads of the lid element 190 and the spout 180. For example, plastic or other suitable materials.

It is further envisioned that the lid elements 190 of FIGS. 6*a* and 6*b* may comprise an annular shoulder element intended to engage an inside wall of the spout 180. The annular shoulder element may provide further sealing of the beverage container 100. Further, having an annular shoulder element engaging an inside wall of the spout 180 provides more structural integrity for the beverage container which is advantageous. When closing the beverage container 100 by pressing the lid element 190 onto the spout 180 the lid element will then provide a tight seal on both the outside and the inside of the spout 180.

Figure 6C:
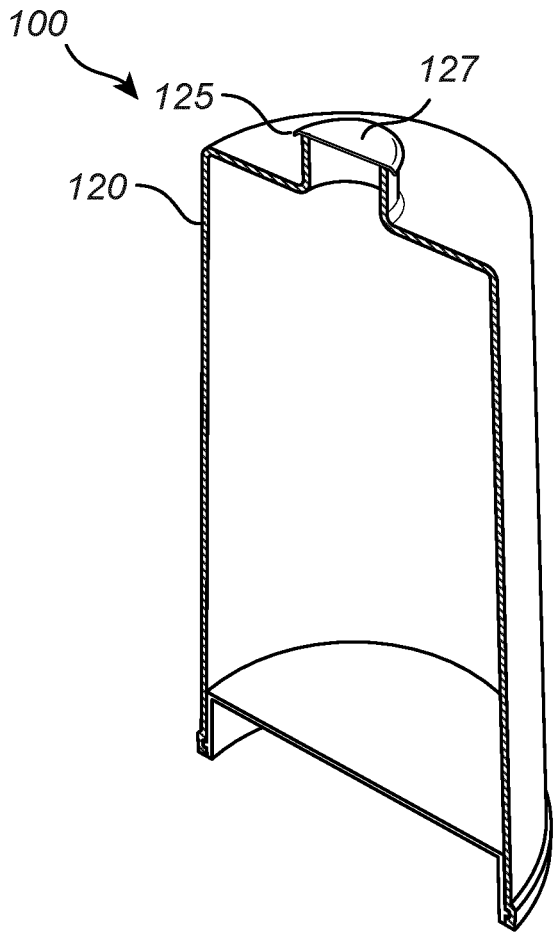

With reference to FIG. 6*c* there is disclosed an illustration of a beverage container 100 according to an embodiment of the invention.

The beverage container 100 of FIG. 6*c* further comprises a sealing surface 125 extending across the top part 120 to ensure that the beverage is kept inside said container body 110. The sealing surface 125 comprises a piercing segment 127, and the piercing segment 127 comprises a material pierceable by a drinking straw. The present embodiment is advantageous in that the sealing structure 150 does not have to be removed to drink. A user may simply pierce the piercing segment 127 with a drinking straw to reach the beverage. The present embodiment is suitable for single use beverage container.

If the beverage container 100 is made of a paper material, the piercing segment 127 may be made of a thinner paper material or the like.

In the embodiment of FIG. 6*c* the piercing segment 127 is placed on a spout-like protrusion protruding from the sealing surface 125. However, it is also envisioned that the piercing segment 127 may be placed in the same plane as the sealing surface 125 giving the beverage container 100 a plane top surface.

Figure 7:
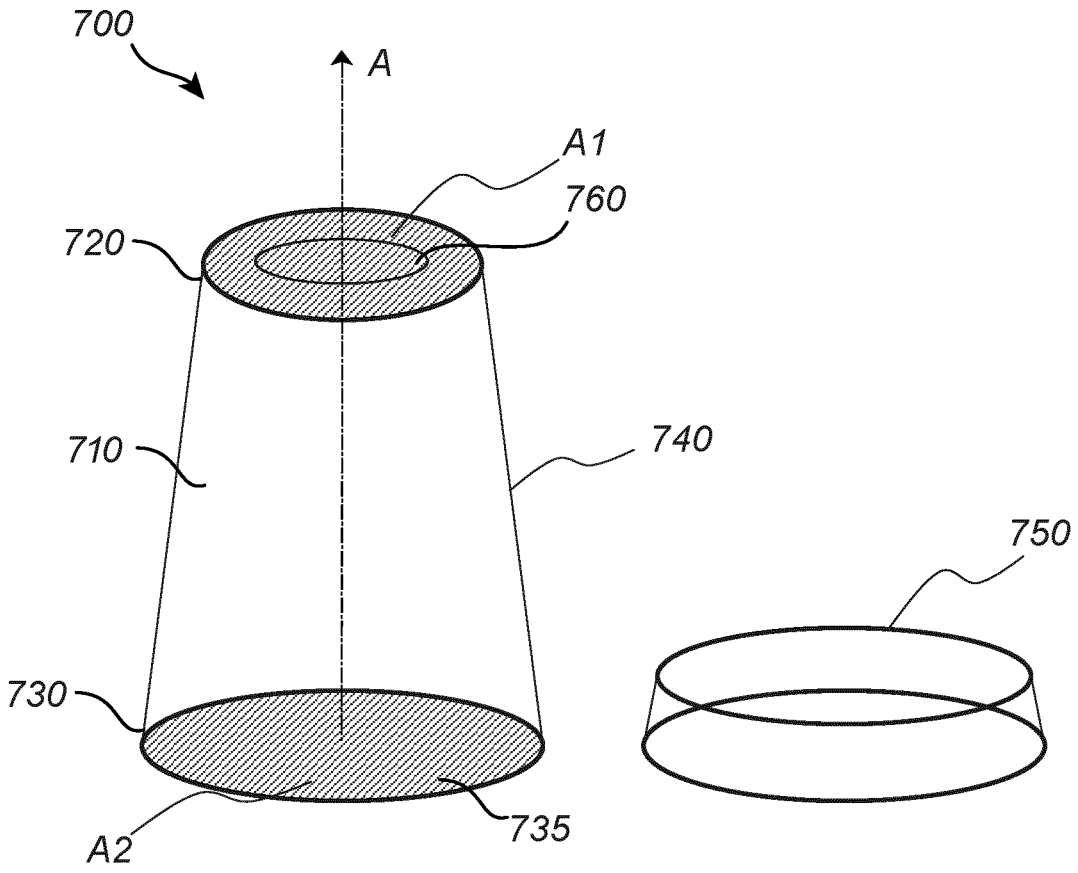
FIG. 7 schematically illustrates an exemplary bottle in accordance with an embodiment.

With reference to FIG. 7 there is disclosed an illustration of a bottle 700 according to an embodiment of the invention.

The bottle 700 is configured to hold a fluid or granular substance. The bottle 700 is extending along an axis A and comprising a container body 710 configured to hold the fluid or granular substance. The container body 710 comprises a top part 720 comprising a first cross-sectional area A1 and a bottom part 730 comprising a second cross-sectional area A2. The second cross-sectional area A2 is larger than the first cross-sectional area A1. The bottom part 730 comprises a first opening 735. The container body 710 further comprises a container wall 740 extending from the top part 720 to the bottom part 720 giving the container body 710 a tapered shape. The bottle 700 further comprises a sealing structure 750 configured to seal the first opening 735. Further, the bottle 700 comprises a sealed second opening 760.

The bottle 700 in FIG. 7 comprises a first opening 735 extending over the full second cross-sectional area A2. The sealing structure 750 may have the same area and be configured to be pressed into the first opening 735. Friction from the bottom part 730 will hold the sealing structure 750 in place due to the tapered shape of the container body 710. The shape of bottle 700 may for example be at least partially conical to achieve the tapered shape.

The top part 720 and bottom part 730 may have circular cross-sections, so that the areas A1, A2 define the areas of circles. The top part 720 and bottom part 730 may also have cross-sections defining other shapes, for example elliptical shapes.

The bottle 100 may be provided to a user empty and in stacks. Due to the tapered shape of the bottle 100 one bottle 100 easily fits inside another bottle 100 according to the invention. The same goes for the sealing structure 150 which can also be delivered in stacks.

The sealed second opening 760 may be placed in the top part as disclosed in FIG. 7. It may also be placed on the container wall 740 or any other part of the bottle 700. The sealed second opening 760 may be configured to be opened by a person intending to drink or reach the content of the bottle 700. It may for example be covered by a permeable surface and reached by piercing the permeable surface with a straw. Further embodiments possible are presented in relation to other Figures of the present application.

The first opening 735 extends over the full second cross-sectional area A2 in FIG. 7. And the top part 720 is completely covered or sealed so that when the bottle 700 is filled from the bottom part 730 is cannot exit the bottle from the top part 720. The bottle 700 is closed by pressing the sealing structure 750 into the first opening 735 after filling the bottle 700. When the sealing structure 750 is placed in the bottle 700 the bottle 700 is completely sealed, and to open it one can may for example open the sealed second opening 760.

Figure 8:
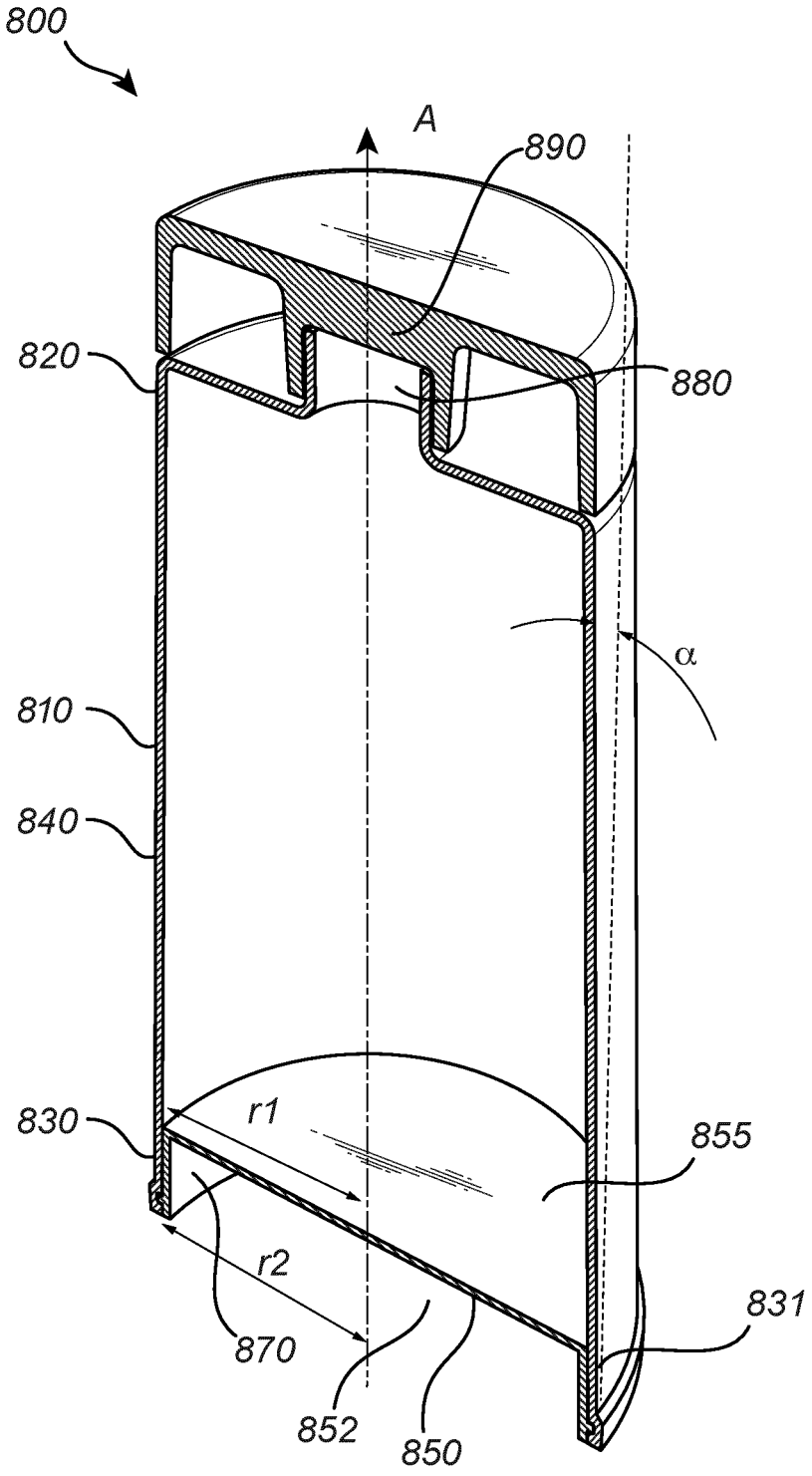
FIG. 8 schematically illustrates an exemplary bottle in accordance with an embodiment.

With reference to FIG. 8 there is disclosed an illustration of a bottle 800 according to an embodiment of the invention.

The bottle 800 may be the bottle 800 presented in FIG. 7 in case the bottom part 830 and top part 820 have circular cross-sections. It is however also possible to have elliptical cross-sections, or other shapes.

The bottle 800 is configured to hold a fluid or granular substance and is extending along an axis A. The bottle 800 comprises a container body 810 which is configured to hold the fluid or granular substance. The container body 810 comprises a top part 820 and a bottom part 830 arranged in an opposite end of the container body compared to the top part. The bottom part 830 comprises a first circular cross-section with a first radius r1 in a plane transverse to the axis A. The bottom part 830 further comprises a second circular cross-section with a second radius r2 in a plane transverse to the axis A. The second radius r2 is larger than the first radius r1. Further, the bottom part 830 comprises an annular wall 831 extending from the second circular cross-section to the first circular cross-section such that the annular wall 831 is formed with an angle alpha $\alpha$ in relation to the axis A. The bottom part 830 is arranged so that the first circular cross-section is facing the top part 820. The bottle 800 further comprises a container wall 840 extending from the top part 820 to the bottom part 830, giving the bottle 800 a tapered shape.

The bottle 800 further comprises a sealing structure 850. The sealing structure 850 comprises a circular bottom plate 855 configured to seal the container body 810. The sealing structure 850 further comprises a sealing wall 870 extending around the circular bottom plate 855 and tilted with the angle $\alpha$ in relation to the axis A. The sealing wall 870 is configured to engage the annular wall 831. The sealing structure 850 is configured to be pressed into the first opening 835 in the bottom part 830 to seal the bottle 800.

The bottom part 830 is arranged so that it has an at least partially conical shape and the sealing structure 850 is arranged so that it fits the shape of the bottom part 830 so that when it is pressed into the bottom part 830 it is stuck and creates a seal for the bottle 800. This is achieved by choosing a suitable angle alpha $\alpha$ and material for the parts of the bottle 800.

The angle alpha $\alpha$ may be between 2-8 degrees. It may also be between 4-6 degrees. The angle alpha $\alpha$ may be picked depending on the material of the bottle 800 and depending on the friction that is created between the sealing wall 870 and the bottom part 830. A too large angle alpha $\alpha$ is not preferable since the sealing structure 850 may fall out of the bottom part 830. An angle alpha $\alpha$ around 6 degrees is preferable. However, it may, as stated, be different angles for different embodiments and materials that are preferable.

The bottle 800 disclosed in FIG. 8 has more features than the bottle 800 disclosed in FIG. 7, these are features that may be preferred depending on the type of bottle 800 needed.

The top part 820 comprises a spout 880 which is fluidly connected to the container body and is configured to deliver the fluid or granular substance to a user. The bottle 800 further comprises a lid element 890 configured to seal the spout 880. The sealed second opening may be arranged in the spout 880 so that it is sealed by the lid element 890. The spout comprises an annular spout wall tilted an angle between 2-8 degrees in relation to the axis A. The lid element 890 comprises a lid indentation 895 and is configured to be pressed down on the spout 880 so that the spout 880 is enclosed by the lid indentation 895. The present embodiment is advantageous in that the sealing structure 850 does not have to be removed to reach the fluid or granular substance. The spout 880 and the lid element 890 in FIG. 8 are closed in the same fashion as the first opening 835 of the bottom part 830 and the sealing structure 850, but instead it is the lid element 890 which is pressed onto the spout 880 achieving a seal. The present embodiment is suitable for reusable and refillable bottles 800. A user may fill the bottle through the spout 880. A user may also fill the bottle through the bottom part 830 the first time and then sequentially through removing the lid element 890 and filling through the spout 880.

In the bottle 800 of FIG. 8 the circular bottom plate 855 is placed at a top end of the sealing wall 870 so that the sealing structure 850 comprises a hollow space 852 facing away from the container body 810 along the axis A. The present embodiment is advantageous in that the hollow space 852 may be sufficiently large to enclose the top part 820 of another bottle 800. This is advantageous when packing or stacking many of the bottles 800 and allows for a tight and compact packing. This may help in decreasing the environmental footprint of the product and the cost of transporting.

The sealing structure 850 may comprise a contrasting color compared to the container body 810, and the sealing structure 850 may be configured to be fully enclosed by the bottom part 830. The present embodiment is advantageous in that it may help a user understand when the bottle 800 is sufficiently closed. If the sealing structure 850 is not correctly placed it will stick out from the bottom part 830, and due to the contrasting color be visible to the user. This is advantageous in that the user then may correct the mistake and close the bottle 800 correctly.

The bottle 800 is easily stacked both when filled and when unfilled. When the different parts of the bottle 800 are delivered they may be stacked in a convenient way. For example, many container bodies 810 may be stacked inside one another and many sealing structures 850 may be stacked inside one another. This would allow a user filling many bottles 800 with a beverage (or with any other substance, such as rice or salt) may take a container body 810 from one stack. Then fill the container body 810 and take a sealing structure 850 from another stack and close the bottles 800. The invention provides an easy and efficient way for customers to fill plenty of bottles 800 without the need for special machines or equipment.

The bottle 800 may be made of a paper material. In some embodiments only certain parts of the bottle may be made of a paper material.

With paper material is meant any material that is made of fiber-based, cellulose-based materials or similar materials that are biodegradable and recyclable.

The parts of the bottle 800 may for example be made of a fiber-based material. For example, a fiber-based slurry can be pressed or shaped to form some sort of paper material, cardboard material, or other biodegradable material.

The paper material may be formed by a fiber-based slurry. Fiber-based products are biodegradable, compostable and do not end up in the oceans in the same capacity as plastics. Therefore, they are preferable to be used as an alternative to many plastic products available today.

In different embodiment the parts of the bottle 800 may be formed by different types of fiber-based slurries. Here follow a few examples, however they are not seen as limiting and other materials and mixtures and proportions are also considered.

The paper material may be formed by a fiber-based slurry that may comprise at least 50% by weight of old corrugated container (OCC). Further, it may comprise a moisture barrier, and an oil barrier. The moisture barrier and the oil barrier may be in a range of about 1%-4% of weight respectively.

The paper material may be formed by a fiber-based slurry that may, in another embodiment, comprise at least 10% softwood (SW). Further, it may comprise a moisture barrier, and an oil barrier. The moisture barrier and the oil barrier may be in a range of about 1%-4% of weight respectively.

The fiber-base slurry may also have a base fiber from any of the following groups: bagasse, bamboo, newsprint (NP). Other types of fiber materials are also available for forming the paper material.

The fiber-based slurry may also comprise a strength additive in a range of 1.5%-4% by weight. This may be added to enhance structural rigidity.

Molding paper pulp, fiber-materials, is a standard way of making containers, trays, and other types of packaging. Generally, the steps are as follows: A mold is made to be a mirror image of the finished paper product; Holes are drilled through the mold and a screen attached to its surface; The mold is immersed into paper pulp; A vacuum is drawn through the holes when the mold is immersed in the paper pulp so that a layer of paper pulp sticks to the mold, the screen prevents pulp from clogging the holes.

The mold is removed, and the paper pulp stuck to the side of the mold is removed and dried, a paper product has been created. Depending on the type of paper product different techniques may be used for removing the product from the mold. In what is known as "wet" manufacturing a transfer mold mates with the fiber product and moves the formed "wet part" to a hot press which compresses and dries the fiber material to increase density and to provide a smooth external surface finish.

The parts of the bottle 800 may be formed according to the above stated procedure by the fiber-based slurry and a vacuum former. It may be formed for example by a method containing the steps of providing a fiber-based slurry mixture. Immersing a mold including a wire mesh comprising a mirror image of parts of the bottle to be formed. Then drawing a vacuum across the wire mesh to cause the fiber-based slurry to accumulate at a surface of the wire mesh. Then removing the mold from the fiber-base slurry mixture, removing molded parts from the surface of the wire mesh. Lastly pressing the molded parts in a hot press. However, other steps of standard vacuum forming may be incorporated into the method for achieving a functional bottle 100 and corresponding container parts.

The different parts of the bottle 800 may be formed in other ways as well. For example, a female and male mold of the container body 810 may be constructed. A fiber-based slurry, or other suitable material, may be poured into the female mold. The male mold may then be used to press the material to the sides of the female mold creating the correct shape. The molds may be constructed so that the water within the material is drained away through a mesh in the female and male mold while pressing.

Other ways of forming the bottle 800 and the different parts of the bottle are also possible, and the skilled man understands that different options are available. Depending on the part and depending on different features of the embodiments different ways of forming the paper material may be preferable.

It may further be advantageous for the bottle 800 to comprise a water impermeable coating. The coating may be made of a plastic material and may be a thin sheet covering an inside of the bottle 800. For example, an inner side of the container body 810 and a top side of the circular bottom plate 855. The coating may be impermeable and allow for the beverage to be stored without penetrating the coating and reaching the walls of the bottle 800. The coating may be made from a plastic material or any other suitable material which is water impermeable, for example some cellulose-based materials.

Depending on the beverage or substance stored within the bottle 800 and the time the substance is stored the bottle 800 may comprise such a coating. For example, some beverages affect or damage paper-materials more than others, and therefore a coating may be needed for certain beverages. Further, depending on the storage time of the beverage within the bottle 800 a coating may be preferable. The longer a beverage is kept within the bottle 800 the higher the risk that the bottle 800 is affected be the beverage. Therefore, a coating may be preferable for bottles 800 configured to store a beverage a longer period. The coating may have different thicknesses depending on the material it is made from and depending on the beverage to be stored.

Further, it is also possible that parts of the bottle 800 are made of other materials. For example, the lid element 890 may be made of plastic, silicon, or a metal. The lid element 890 may then be used multiple times and on different bottle 800 in case of the original bottle 800 being damaged. It may be advantageous in making some parts of the bottle 800 from material that is more durable and suitable for long time use and some parts of the bottle 800 of more environmentally friendly material such as fiber-based materials. For example, a silicon or metal lid element 890 may be customizable and fit all bottle 800. A user may then have a lid element 890 with a certain color so that a user knows it is their bottle 800.

It is further envisioned that the lid element 890 may comprise an annular shoulder element intended to engage an inside wall of the spout 880. The annular shoulder element may provide further sealing of the bottle 800. Further, having an annular shoulder element engaging an inside wall of the spout 880 provides more structural integrity for the bottle 800 which is advantageous. When closing the bottle 800 by pressing the lid element 890 onto the spout 880 the lid element will then provide a tight seal on both the outside and the inside of the spout 880.

There is also provided a method for filling a bottle 800 as disclosed within the application. The method comprises the steps of removing a container body from a stack of container bodies. Filling the container body with a fluid or granular substance. Removing a sealing structure from a stack of sealing structures. And sealing a first opening of the container body with the sealing structure.

Filling the bottle 800 from the first opening 835 in the bottom part 830 may be advantageous to do when filling the bottle 800 the first time. Sequential times, if the bottle 800 is used as a refillable container, a user may fill the bottle 800 through the second sealed opening located in the spout 880 by removing the lid element 890.

Although features and elements are described above in particular combinations, each feature or element can be used alone without the other features and elements or in various combinations with or without other features and elements.

Additionally, variations to the disclosed embodiments can be understood and effected by the skilled person in practicing the claimed invention, from a study of the drawings, the disclosure, and the appended claims. In the claims, the word "comprising" does not exclude other elements, and the indefinite article "a" or "an" does not exclude a plurality. The mere fact that certain features are recited in mutually different dependent claims does not indicate that a combination of these features cannot be used to advantage.

LIST OF EXAMPLES

1. A bottle (00) configured to hold a fluid or granular substance and extending along an axis A, said bottle comprising:
   - a container body (10) configured to hold said fluid or granular substance comprising:
     - a top part (720) comprising a first cross-sectional area (A1);
     - a bottom part (30) comprising a second cross-sectional area (A2), wherein said second cross-sectional area is larger than said first cross-sectional area, and wherein said bottom part comprises a first opening (735); and
     - a container wall (740) extending from said top part to said bottom part giving said container body a tapered shape; and
   - a sealing structure (750) configured to seal said first opening; and
   - a sealed second opening (760).

2. The bottle according to example 1 wherein said sealed second opening is arranged in said top part.

3. The bottle according to example 1, wherein said sealed second opening is arranged on said container wall.

4. The bottle according to any one of the preceding examples wherein said bottom part comprises an annular wall (731) tilted with an angle alpha ($\alpha$) in relation to said axis A, and wherein said sealing structure comprises;
   - a bottom plate (755) configured to seal said container body; and
   - a sealing wall (770) extending around said bottom plate and tilted with said angle alpha in relation to said axis A, wherein said sealing wall is configured to engage said annular wall, and wherein said sealing structure is configured to be pressed into said first opening to seal said bottle.

5. The bottle according to example 4, wherein said angle alpha is between 2-8 degrees, and more preferably between 4-6 degrees.

6. The bottle according to example 4 or 5, wherein said sealing wall comprises a sealing rim (775) extending around said sealing wall and protruding in a radial direction from said sealing wall from said axis A, and wherein said annular wall comprises a receiving recess (737) extending around an inside of said bottom part and configured to receive said sealing rim when said sealing structure is pressed into said first opening.

7. The bottle according to any one of the preceding examples further comprising a spout (780) and a lid element (790) configured to cover said spout, wherein said sealed second opening is arranged in said spout so that it is sealed by said lid element.

8. The bottle according to example 7 wherein said spout comprises an annular spout wall (785) tilted an angle between 2-8 degrees in relation to said axis A, and wherein said lid element comprises a lid indentation (195) and is configured to be pressed down on said spout.

9. The bottle according to example 7 wherein said spout comprises a spout sealing rim (782) extending around said spout, and wherein said lid element comprises a spout sealing recess (792) configured to receive said spout sealing rim upon pressing said lid element onto said spout.

10. The bottle according to example 7 wherein said spout comprises a set of spout threads (784) extending around said spout, and wherein said lid element comprises a set of corresponding threads (794) configured to engage said set of spout threads upon screwing said lid element onto said spout.

11. The bottle according to any one of the preceding examples further comprising a permeable surface (781) arranged over and sealing said sealed second opening and configured to be pierceable or removed.

12. The bottle according to any one of the preceding examples, wherein said bottle is made of a paper material.

13. The bottle according to example 11, wherein said paper material is formed from a fiber-based slurry comprising;

a fiber base comprising at least 50% by weight of old corrugated container (OCC);

a moisture barrier; and an oil barrier, wherein said moisture barrier and said oil barrier are in a range of about 1%-4% by weight respectively.

14. The bottle according to example 11, wherein said paper material is formed from a fiber-based slurry comprising;

a fiber base comprising at least 10% softwood (SW);

a moisture barrier; and an oil barrier, wherein said moisture barrier and said oil barrier are in a range of about 1%-4% by weight respectively.

15. A method for filling a bottle according to example 1 with a fluid or granular substance comprising;

removing a container body from a stack of container bodies;

filling said container body with said fluid or granular substance;

removing a sealing structure from a stack of sealing structures; and sealing a first opening of said container body with said sealing structure.

The invention claimed is:

1. A container configured to hold a substance and extending along a longitudinal axis, said container comprising:

a container body configured to hold said substance comprising:

a top part;

a closure section being a bottom part of the container body and arranged in an opposite end of the container body compared to said top part, comprising:

a first circular cross-section with a first radius in a plane transverse to said axis;

a second circular cross-section with a second radius in a plane transverse to said axis, wherein said second radius is larger than said first radius; and an annular wall extending from said second circular cross-section to said first circular cross-section such that said annular wall is formed with an angle alpha in relation to said axis, wherein said closure section is arranged so that said first circular cross-section is closer to said top part along said axis than the second circular cross-section;

a container wall forming sides of said container around the axis and extending from said closure section to said top part, said annular wall of said closure section forming one end of said container wall; and the container further comprising a sealing structure comprising;

a circular bottom plate configured to seal said container body; and a sealing wall extending around said circular bottom plate and tilted with said angle alpha in relation to said longitudinal axis, wherein said sealing wall is configured to engage said annular wall, and wherein said sealing structure is configured to be pressed into said closure section to seal said container, and wherein said angle alpha is between 2-8 degrees, wherein said container body and said sealing structure are made of a molded paper material, and wherein said top part further comprises;

a spout connected to said container body and configured to deliver said substance to a user; and a lid element configured to seal said spout, said lid element being made of a molded paper material, wherein said spout comprises an annular spout wall tilted with a further angle between 2-8 degrees in relation to said longitudinal axis, wherein said lid element comprises a lid indentation at a central location of the lid element and said lid element is configured to be pressed down on said spout to achieve a seal between said annular spout wall and said lid element; and wherein said lid indentation comprises an inner wall tilted with the further angle in relation to the longitudinal axis.

2. The container according to claim 1 wherein said angle alpha is between 4-6 degrees.

3. The container according to claim 1 wherein said spout comprises a spout sealing rim extending around said annular spout wall, and wherein said lid element comprises a spout sealing recess extending around said lid indentation and configured to receive said spout sealing rim upon pressing the lid element onto said spout.

4. The container according to claim 1 further comprising, a sealing surface extending across said top part to ensure that said substance is kept inside said container body, wherein said sealing surface comprises a piercing segment, and wherein said piercing segment comprises a material pierceable by a drinking straw.

5. The container according to claim 1, wherein said sealing wall comprises a sealing rim extending around said sealing wall and protruding in a radial direction from said sealing wall and from said longitudinal axis, and wherein said closure section comprises a receiving recess extending around an inside of said closure section and configured to receive said sealing rim when said sealing structure is pressed into said closure section.

6. The container according to claim 1, wherein said sealing structure comprises a contrasting color compared to said container body, and wherein said sealing structure is configured to be fully enclosed by said closure section.

7. The container according to claim 1, wherein said circular bottom plate is placed at a top end of said sealing wall so that said sealing structure comprises a hollow space facing away from said container body along said longitudinal axis.

8. The container according to claim 1, wherein said paper material is formed from a fiber-based slurry comprising;

a fiber base comprising at least 50% by weight of old corrugated container (OCC);

a moisture barrier; and an oil barrier, wherein said moisture barrier and said oil barrier are in a range of about 1%-4% by weight respectively.

9. The container according to claim 8, wherein said fiber-based slurry further comprises a strength additive in a range of 1.5%-4% by weight.

10. The container according to claim 1, wherein said paper material is formed from a fiber-based slurry comprising;

a fiber base comprising at least 10% softwood (SW);

a moisture barrier; and an oil barrier, wherein said moisture barrier and said oil barrier are in a range of about 1%-4% by weight respectively.

11. The container according to claim 10, wherein said fiber-based slurry further comprises a strength additive in a range of 1.5%-4% by weight.

12. The container according to claim 1, wherein at least an inside surface of said container body or a top side of said sealing structure comprises an impermeable coating layer.

* * * * *